US011021940B2

(12) United States Patent
Juranitch

(10) Patent No.: US 11,021,940 B2
(45) Date of Patent: Jun. 1, 2021

(54) METHOD, APPARATUS AND SYSTEM FOR ENHANCED OIL AND GAS RECOVERY WITH DIRECT STEAM GENERATION, MULTIPHASE CLOSE COUPLED HEAT EXCHANGER SYSTEM, SUPER FOCUSED HEAT

(71) Applicant: XDI Holdings, LLC, Bedford, NH (US)

(72) Inventor: James C. Juranitch, Fort Lauderdale, FL (US)

(73) Assignee: XDI Holdings, LLC, Bedford, NH (US)

( * ) Notice: Subject to any disclaimer, the term of this patent is extended or adjusted under 35 U.S.C. 154(b) by 283 days.

(21) Appl. No.: 15/778,013

(22) PCT Filed: Nov. 22, 2016

(86) PCT No.: PCT/US2016/063358
§ 371 (c)(1),
(2) Date: May 22, 2018

(87) PCT Pub. No.: WO2017/087990
PCT Pub. Date: May 26, 2017

(65) Prior Publication Data

US 2018/0320495 A1 Nov. 8, 2018

Related U.S. Application Data

(60) Provisional application No. 62/258,513, filed on Nov. 22, 2015.

(51) Int. Cl.

| | |
|---|---|
| ***E21B 43/24*** | (2006.01) |
| ***F22B 1/18*** | (2006.01) |
| ***F22B 37/56*** | (2006.01) |
| ***E21B 43/34*** | (2006.01) |
| *F22B 35/10* | (2006.01) |
| *F22G 3/00* | (2006.01) |

(52) U.S. Cl.
CPC ..... *E21B 43/24* (2013.01); *E21B 43/2406* (2013.01); *E21B 43/34* (2013.01); *F22B 1/18* (2013.01); *F22B 37/56* (2013.01); *F22B 35/10* (2013.01); *F22G 3/00* (2013.01)

(58) Field of Classification Search
CPC ..... E21B 43/2406; E21B 43/24
See application file for complete search history.

(56) References Cited

U.S. PATENT DOCUMENTS

| | | | | |
|---|---|---|---|---|
| 3,118,429 | A | 1/1964 | Hochmuth | |
| 3,150,716 | A * | 9/1964 | Strelzoff | E21B 43/24 166/268 |
| 4,028,884 | A | 6/1977 | Martz et al. | |
| 4,330,038 | A | 5/1982 | Soukup et al. | |
| 4,498,542 | A | 2/1985 | Eisenhawer et al. | |
| 4,641,710 | A * | 2/1987 | Klinger | E21B 36/00 166/266 |

(Continued)

*Primary Examiner* — Shane Bomar
(74) *Attorney, Agent, or Firm* — Dykema Gossett PLLC

(57) ABSTRACT

A system for improving a steam oil ratio (SOR) includes a direct steam generator (DSG) boiler fluidly coupled with a downhole portion of a steam system via at least a DSG outlet, wherein the DSG boiler is configured to schedule super-heat delivered to the downhole portion to optimize the SOR associated with the system.

16 Claims, 2 Drawing Sheets

(56) References Cited

U.S. PATENT DOCUMENTS

| | | | | |
|---|---|---|---|---|
| 2008/0190607 | A1 | 8/2008 | Minnich et al. | |
| 2008/0289822 | A1* | 11/2008 | Betzer Tsilevich | F22B 1/22 166/272.3 |
| 2010/0282644 | A1* | 11/2010 | O'Connor | E21B 43/24 208/427 |
| 2012/0000642 | A1 | 1/2012 | Betzer Tsilevich | |
| 2012/0325470 | A1* | 12/2012 | Gupta | E21B 43/2406 166/272.3 |
| 2013/0175031 | A1* | 7/2013 | Kerr | E21B 43/2406 166/272.3 |
| 2013/0206399 | A1* | 8/2013 | Pimenov | E21B 47/07 166/250.01 |
| 2014/0110109 | A1 | 4/2014 | Latimer et al. | |
| 2014/0318792 | A1 | 10/2014 | Chen et al. | |
| 2016/0348895 | A1 | 12/2016 | Juranitch | |
| 2017/0074082 | A1* | 3/2017 | Palmer | E21B 43/24 |

* cited by examiner

METHOD, APPARATUS AND SYSTEM FOR ENHANCED OIL AND GAS RECOVERY WITH DIRECT STEAM GENERATION, MULTIPHASE CLOSE COUPLED HEAT EXCHANGER SYSTEM, SUPER FOCUSED HEAT

CROSS-REFERENCE TO RELATED APPLICATION

This application is a national stage application of International patent application no. PCT/US2016/063358, filed 22 November 201 and published under International publication no. WO 2017/087990 A1 on 26 May 2017 (the '358 application). This application claims priority to U.S. provisional patent application No. 62/258,513 entitled "METHOD, APPARATUS AND SYSTEM FOR ENHANCED OIL AND GAS RECOVERY WITH DIRECT STEAM GENERATION, MULTIPHASE CLOSE-COUPLED HEAT EXCHANGER SYSTEM, SUPER FOCUSED HEAT," filed 22 Nov. 2015 (the '513 application). The '358 application and the '513 application are both hereby incorporated by reference as though fully set forth herein.

FIELD

Embodiments of the present disclosure generally relate to a method, apparatus, and system for the optimization of oil and gas recovery using steam, a direct steam generator (DSG), an optional multiphase close-coupled heat exchanger system and super-heat.

DESCRIPTION OF THE RELATED ART

Many steam boilers are used in the oil and gas recovery world such as Once Through Steam Generators (OTSG) and Drum Boilers. These steam boilers can be used to generate a saturated steam for enhanced oil and gas recovery.

SUMMARY

Various embodiments of the present disclosure can include a system for improving a steam oil ratio (SOR). The system can include a direct steam generator (DSG) boiler fluidly coupled with a downhole portion of a steam system via at least a DSG outlet, wherein the DSG boiler is configured to schedule super-heat delivered to the downhole portion to optimize the SOR associated with the system.

Various embodiments of the present disclosure can include a system for improving a SOR. The system can include a DSG boiler, wherein the DSG boiler is run in a manner to create super-heat. An additional super-heater can be run in series with the DSG boiler. A downhole portion of a steam system can be fluidly coupled with the additional super-heater via at least a DSG outlet, wherein the DSG boiler and the additional super-heater are configured to schedule super-heat delivered to the downhole portion to optimize the SOR associated with the system.

Various embodiments of the present disclosure can include a system for improving a SOR. The system can include a DSG boiler, wherein the DSG boiler is run in a manner to create saturated steam. An additional super-heater can be run in series with the DSG boiler. A downhole portion of a steam system can be fluidly coupled with the additional super-heater via at least a DSG outlet, wherein the additional super-heater is configured to schedule super-heat delivered to the downhole portion to optimize the SOR associated with the system.

Various embodiments of the present disclosure can include a system for improving a SOR. The system can include a DSG boiler. A multi-phase close-coupled heat exchanger can be fluidly coupled with the DSG boiler, where the DSG boiler is run in a manner to create super-heat. A downhole portion of a steam system can be fluidly coupled with the close coupled heat exchanger, wherein the DSG boiler is configured to schedule super-heat delivered to the downhole portion to optimize the SOR associated with the system.

Various embodiments of the present disclosure can include a system for improving a SOR. The system can include a DSG boiler, wherein the DSG boiler is run in a manner to create super-heat. A multiphase close-coupled heat exchanger can be fluidly coupled with the DSG boiler. A super-heater can be run in series and fluidly coupled with the DSG boiler and the multiphase close-coupled heat exchanger system. A downhole portion of a steam system can be fluidly coupled with the super-heater, wherein the DSG boiler and the super-heater are configured to schedule super-heat delivered to the downhole portion to optimize the SOR associated with the system.

Various embodiments of the present disclosure can include a system for improving a SOR. The system can include a DSG boiler, wherein the DSG boiler is run in a manner to create saturated steam. A multiphase close-coupled heat exchanger can be fluidly coupled with the DSG boiler. A super-heater can be run in series and fluidly coupled with the DSG boiler and the multiphase close-coupled heat exchanger system. A downhole portion of a steam system can be fluidly coupled with the super-heater, wherein the super-heater is configured to schedule super-heat delivered to the downhole portion to optimize the SOR associated with the system.

Various embodiments of the present disclosure can include a method for improving a SOR. The method can include providing super-heat with at least one of a direct steam generator (DSG) boiler and a super-heater fluidly coupled in series with a downhole portion of a steam system to the downhole portion of the steam system, wherein the DSG boiler is fluidly coupled with the super-heater via a DSG outlet and the super-heater is fluidly coupled with the downhole portion of the steam system via a super-heater outlet conduit. The method can include determining whether a condensate loss from the super-heater outlet conduit is greater than a defined condensate loss value. The method can include adjusting the amount of super-heat based on the determination of whether the condensate loss from the super-heater outlet conduit is greater than the defined condensate loss value.

DETAILED DESCRIPTION

Figure 1:
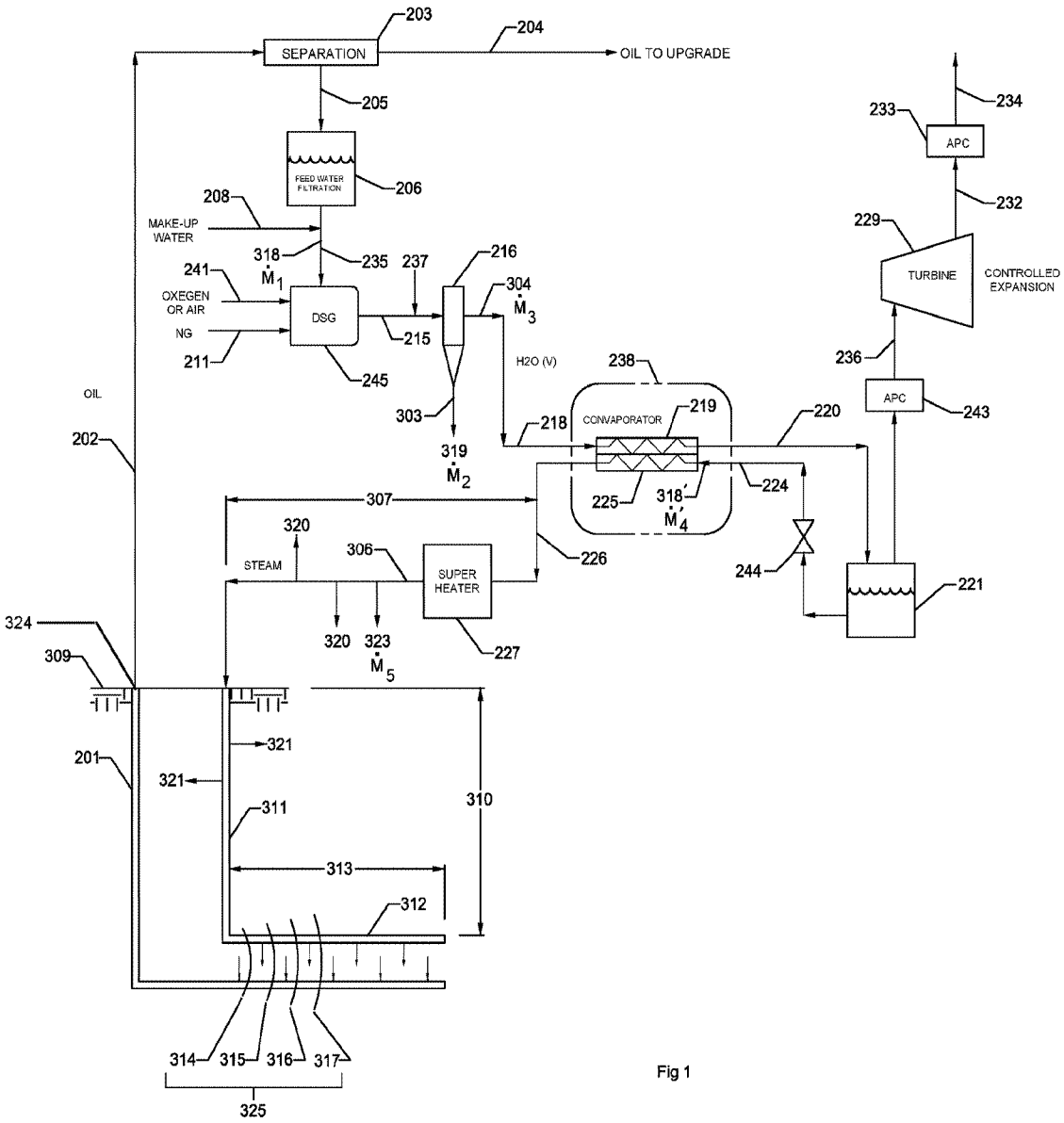
FIG. 1 depicts an apparatus and system for enhanced oil and gas recovery with direct steam generation, multi-phase, close-coupled heat exchanger system, and super focused heat, in accordance with embodiments of the present disclosure.

U.S. patent application Ser. No. 15/166,109 entitled "PLASMA ASSISTED, DIRTY WATER, DIRECT STEAM GENERATION SYSTEM, APPARATUS AND METHOD," filed on 26 May 2016, which is hereby incorporated by reference as through fully set forth herein, discloses a number of DSG methods of steam generation which optionally included a super-heater and the use of super-heat. U.S. patent application Ser. No. 15/778,010 entitled "METHOD, APPARATUS, AND SYSTEM FOR ENHANCED OIL AND GAS RECOVERY WITH SUPER FOCUSED HEAT," filed on even date herewith, which is hereby incorporated by reference as though fully set forth herein, discloses the optimization of super heat for gas and oil recovery in applications not related to DSGs or multiphase close-coupled heat exchanger systems.

Embodiments of the present disclosure can include a system, method, and apparatus comprising a DSG, an optional multi-phase, close-coupled heat exchanger system, and an optional super-heater. Super-heated steam can be generated and utilized for enhanced oil and gas recovery. The scheduling and optimization of the super-heated steam can be scheduled or controlled by, for example, a math function. The scheduling and math function can be continuously improved through an iterative process using multiple feedbacks such as condensate flow, process temperature, process pressures, process flows, system energy, and Steam Oil Ratio (SOR) for optimization. Super-heat at the DSG can also be used to aid in impurity separation and minimize or eliminate blow down.

In enhanced oil and gas recovery, steam is often used. This can include the use of Steam Assisted Gravity Drain (SAGD), Cyclic Steam Stimulation (CSS), and other types of oil and gas recovery. To date, a steam boiler can be utilized to generate a saturated steam, which can then be directed to melt out or mobilize the oil and gas in underground deposits. Typically, a Once Through Steam Generator (OTSG) or a Drum Boiler can be used to generate the steam, which is often saturated steam. The steam can then be pumped through a series of conduits or pipes, eventually traveling underground to the desired heavy oil or other desired deposit. The steam in most cases can be generated as saturated steam at the outlet of the boiler. The saturated steam can then be directed through the balance of the oil or gas recovery system. Much heat and steam energy can be lost in the process without the benefit of producing a product such as bitumen or heavy oil. The industry keeps score on a site's oil recovery efficiency with a Steam Oil Ratio. The SOR simply logs the metric of how many barrels of water in the form of steam are required to net a barrel of oil. SORs can range from approximately 2 to 6. All sites and operators desire the lowest operating SOR possible. The SOR at a site can directly relate to the cost of oil recovery.

Steam in its many forms has different heat transfer characteristics/coefficients. These heat transfer coefficients then directly relate to the amount of heat energy transferred from the steam as it passes through a system or pipe. The amount of heat energy transferred can vary dramatically. For example, at a given steam pressure and temperature, the heat energy transferred through a pipe can range from a factor of 1 for super-heated steam to an approximate factor of 10 for saturated steam to a factor of 4 for condensate.

Embodiments of the present disclosure use that characteristic of steam to minimize the amount of steam energy that is currently being wasted in existing enhanced oil or gas recovery systems. Embodiments of the present disclosure can utilize a mathematical model (implemented, for example, in the software or firmware of a control system) to schedule the super-heated steam. Embodiments of the present disclosure can utilize a feedback in the form of the SORs for continuous improvement or Kaizen in the mathematical model and oil recovery site.

Embodiments of the present disclosure can be applied to two specific and special steam systems known as Direct Steam Generation (DSG) systems and DSG systems combined with multiphase close-coupled heat exchanger systems.

Embodiments of the present disclosure can improve the efficiency of an enhanced oil or gas recovery site. As an example, SAGD can be used to describe one embodiment of this invention. Some embodiments of the present disclosure can be used to optimize any steam system or enhanced oil or gas recovery process.

FIG. 1 depicts an apparatus and system for enhanced oil and gas recovery with direct steam generation, multi-phase close-coupled heat exchanger system, and super focused heat, in accordance with embodiments of the present disclosure. As depicted in FIG. 1, water can be injected into a DSG boiler via feed conduit 235 at a first mass flow 318 (depicted as MO. In some embodiments, a production conduit 202 can be fluidly coupled to an oil separation system 203 and can carry the produced water and bitumen to oil separation system 203. Crude oil conduit 204 can be fluidly coupled to the oil separation system 203 and can carry an end product of an SAGD operation. Separated water conduit 205 can be fluidly coupled to the oil separation system 203 and a feed water filtration system 206. The feed conduit 235 can be fluidly coupled with the feed water filtration system 206. In some embodiments, makeup water 208 can be introduced into the feed conduit 235 and can augment the water being fed through feed conduit 235. The water can be processed by a DSG 245 (also referred to herein as DSG boiler) in this example, which can be provided oxygen and/or air via conduit 241. In some embodiments, the DSG 245 can operate on fuels that include, but are not limited to well head gas, natural gas, propane, diesel, and/or bitumen.

In some embodiments, steam (e.g., saturated steam) can be produced by the DSG 245 and can flow through a saturated steam conduit 215 (e.g., DSG outlet conduit), which can be fluidly coupled with the DSG 245 and a separation system 216 (e.g., a blowdown and particulate cleaning system). In some embodiments, sorbents and/or additives can be injected into the saturated steam conduit 215 via sorbent/additive conduit 237. An amount of blowdown 303 with second mass flow 319 (depicted as $M_2$) can be typical in a conventional steam system but may not always be required in a DSG system. In some embodiments, mass flow at any location can be measured by a positive displacement meter with or without numerical mass correction, a turbine flow meter with or without numerical correction, a hot wire mass flow measurement, a Coriolis flow meter, a column and float system, or settling tanks and scale measurement, an orifice plate system, which are only a few examples of how mass flow can be measured. DSG systems can easily generate super-heated steam at their output without the aid of a secondary super-heater. A resulting third mass flow 304 of the steam (depicted as $M_3$), which in some embodiments is at saturated conditions, but not limited to saturated conditions, is transferred into the super-heater 227.

The super-heater 227 is optional, depending on whether the DSG 245 is chosen to be the only unit operated in a super-heat generation mode of operation. A multiphase close-coupled heat exchanger can be included and configured to transfer super-heat or configured to not transfer super-heat, which can affect the choice of including a second optional super-heater 227. For example, if the DSG 245 is operated in a super-heat generation mode and the multiphase close-coupled heat exchanger is included and configured to transfer super-heat, the super-heater 227 may not be used. Conversely, if a close-coupled heat exchanger is not included and the DSG 245 is operated in a super-heat mode, then optional super-heater 227 may or may not be included. In some embodiments of the present disclosure, a total super-heat can be produced from the DSG alone, or from a combination of a DSG in communication with an additional super-heater.

In some embodiments, steam (e.g., saturated steam, super-heated steam) can be fed from the separation system 216 via a conduit 218 to a condenser side 219 of a multiphase combined (close-coupled) heat exchanger 238, as discussed herein. Condensate from the condenser side 219 can be fed to a separator tank 221 via conduit 220, which can separate the hot side condensate into a water constituent and an exhaust constituent. The exhaust constituent can be processed via an optional air pollution control process 243 and fed to a turbo expander 229 via conduit 236. Expanded exhaust constituents can be fed via an exhaust conduit 232 to an air pollution control process 233 before being exhausted via treated exhaust outlet 234.

As discussed herein, in some embodiments, a control valve 244 can control a flow of condensate through condensate conduit 224 into the evaporator side 225 of the close-coupled heat exchanger 238. Condensate can be fed into the evaporator side 225 of the close-coupled heat exchanger 238 via the condensate conduit 224 at a fourth mass flow 318' (depicted as $M'_4$). The fourth mass flow 318' ($M'_4$) can be similar with respect to the first mass flow 318 (MO) in the fact that they are mass flows associated with feedwater being fed to a final disposition to a down hole application. In some embodiments, the first mass flow 318 can be associated with the only feedwater origin if a close-coupled heat exchanger 238 is not incorporated; but the fourth mass flow can be associated with the more precise location of the feedwater if a close-coupled heat exchanger 238 and associated process equipment is utilized. In an example, depending on whether the close-coupled heat exchanger 238 is incorporated, either the first mass flow 318 or the fourth mass flow 318' can be associated with a mass flow of feedwater to a final feedwater processing step that turns feedwater into steam for delivery to the down hole application. The condensate in the evaporator side 225 of the close-coupled heat exchanger 238 can be converted to saturated steam or super-heated steam and can be fed through evaporator side steam conduit 226 to the steam injection conduit 228, as discussed in relation to FIG. 1. In some embodiments, a heat exchanger can be fluidly coupled between the evaporator side of the close-coupled heat exchanger and a control valve 244 or between the control valve 244 and the separator tank 21.

In some embodiments, the control valve 244 can control a flow of condensate through condensate conduit 224 into the evaporator side 225 of the close-coupled heat exchanger 238. The condensate in the evaporator side 225 of the close-coupled heat exchanger 238 can be converted to saturated steam or super-heated steam and can be fed through evaporator side steam conduit 226 to an optional super-heater 227.

The process equipment, such as the separator tank 221, air pollution control process 243, turbo expander 229, air pollution control process 233, control valve 244, etc. can optionally be used, depending on whether the close-coupled heat exchanger 238 is incorporated. For example, the process equipment can be used if the close-coupled heat exchanger 238 is incorporated. Further details of the process equipment and additional aspects of the present disclosure will be made apparent upon review of U.S. patent application Ser. No. 15/166,109 entitled "PLASMA ASSISTED, DIRTY WATER, DIRECT STEAM GENERATION SYSTEM, APPARATUS AND METHOD," filed on 26 May 2016, which is hereby incorporated by reference as through fully set forth herein.

The super-heater 227 can be powered by natural gas or any other energy source. In some embodiments it can be advantageous to operate the DSG 245 in a condition that produces super-heated steam at its outlet prior to separation system 216. The super-heated steam production condition at the outlet of the DSG will help in crystalizing and separating out impurities in the feedwater flowing through feed conduit 235 and minimize or eliminate blowdown. The feedwater flowing through feed conduit 235 (e.g., DSG 245 feedwater) can be one or more of dirty water, salty water, and/or brine water including fossil water and/or sea water and/or combinations of produced water, make up water, and/or pond water from oil processing. Collection and separation system 216 is depicted as a conventional cyclone unit but could also be a box, baffle, and/or mesh separation system and/or any other separation system. DSG 245 can, in some embodiments, be operated in a conventional mode with a percentage of blowdown and no super-heat at the DSG outlet (e.g., saturated steam conduit 215) directing the impurities into the separation system 216. The super-heater outlet conduit 306 can have a super-heater outlet length represented by line 307. The super-heater outlet conduit 306 can be used to direct steam to a down hole portion of the enhanced oil site. In some embodiments, heat can be lost from the super-heater outlet conduit 306. Such heat loss is depicted as outlet heat loss 320. In some embodiments, condensate can be lost from the super-heater outlet conduit 306. Such condensate loss is depicted as outlet condensate loss mass flow 323 (also referred to herein as fifth mass flow 323 and depicted as Ms).

The super-heater outlet conduit 306 can be fluidly coupled to a down hole portion 311 of the steam system. In some embodiments, the down hole portion 311 of the steam system can have a down hole portion length represented by line 310. In some embodiments, heat can be lost from the down hole portion 311. Such heat loss is depicted as down hole heat loss 321. Horizontal pipe section 312 in the oil recovery section of a SAGD system can include a perforated pipe system (e.g., perforated pipe section) that expels steam into the oil deposits to mobilize heavy oil (e.g., subterranean heavy oil) and can have a length represented by line 313. Although the horizontal pipe section 312 is described as horizontal, the horizontal pipe section 312 can be disposed at a non-horizontal angle. In some embodiments, the perforated pipe system can ideally expel saturated steam with its superior heat energy being transferred into the oil deposits to mobilize the heavy oil. In an example, the heavy oil can melt out of formations in a continually expanding arc (e.g., melt out of formations located close to and away from the horizontal pipe section 312) as depicted by arced lines 314, 315, 316, and 317, etc. eventually making a chamber 325. The mobilized oil and spent (e.g., condensated) steam is then collected in collection pipe 201, which is configured to collect the mobilized oil and spent steam, and lifted to the surface of the ground 309 to ground surface location (e.g., ground surface location 324) via the collection pipe 201 for transport in production conduit 202 and further processing and eventual sale.

Embodiments of the present disclosure can provide for the addition of super-heat by any method at an optional super-heater 227 and potentially at DSG 245 to increase the energy of the steam and optimize the amount of super-heat in the steam to allow the steam mass flow to ideally be converted to saturated steam at and/or in horizontal pipe section 312 and ideally at the location of new work or heat transfer into the ever expanding chamber 325 for the mobilization of the bitumen at locations depicted by arced lines 314, 315, 316, 317, etc. As the heat loss and condensate loss is minimized in, for example, super-heater outlet conduit 306 and down hole portion 311 and the saturated steam is allowed to effectively deliver its stored energy to the bitumen at locations depicted by arced lines 314, 315, 316, 317, etc. and generally chamber 325, the SOR will be improved and reduced numerically.

The amount of super-heat (e.g., the addition of super-heat by any method at optional super-heater 227 and potentially at DSG 245) can be scheduled by many mathematical models in many embodiments. In some embodiments, an amount of super-heat can be increased until a mass flow at outlet condensate loss mass flow 323 (or a summation of outlet condensate mass flows at all measurement points or any combination thereof) is reduced to 0 (or within a defined threshold of 0). In some embodiments, a feedback control (e.g., proportional-integral-derivative controller (PID)) can be employed to increase super-heat (e.g., via super-heater 227 or the DSG 245) until the mass flow at outlet condensate loss mass flow 323 (or a summation of outlet condensate mass flows at all measurement points or any combination thereof) is reduced to 0 (or within a defined threshold of 0) and then continue to increase super-heat (e.g., via super-heater 227 or the DSG 245) until SOR is eventually minimized. In some embodiments, this process of feedback control can be used for continuous iterations and improvements in efficiency, or Kaizen. Upper limits of super-heated steam temperature boundary conditions can be employed.

In some embodiments, the feedback control can be implemented via a computing device, which can be a combination of hardware and instructions to share information. The hardware, for example can include a processing resource and/or a memory resource (e.g., computer-readable medium (CRM), database, etc.). A processing resource, as used herein, can include a number of processors capable of executing instructions stored by the memory resource. The processing resource can be integrated in a single device or distributed across multiple devices. The instructions (e.g., computer-readable instructions (CRI)) can include instructions stored on the memory resource and executable by the processing resource to implement a desired function (e.g., increase super-heat, etc.).

The memory resource can be in communication with the processing resource. The memory resource, as used herein, can include a number of memory components capable of storing instructions that can be executed by the processing resource. Such memory resource can be a non-transitory CRM. The memory resource can be integrated in a single device or distributed across multiple devices. Further, the memory resource can be fully or partially integrated in the same device as the processing resource or it can be separate but accessible to that device and processing resource. Thus, it is noted that the computing device can be implemented on a support device and/or a collection of support devices, on a mobile device and/or a collection of mobile devices, and/or a combination of the support devices and the mobile devices.

The memory can be in communication with the processing resource via a communication link (e.g., path). The communication link can be local or remote to a computing device associated with the processing resource. Examples of a local communication link can include an electronic bus internal to a computing device where the memory resource is one of a volatile, non-volatile, fixed, and/or removable storage medium in communication with the processing resource via the electronic bus.

An example of an additional embodiment of a mathematical model to schedule the amount of super-heat injected can start the same with the elimination of condensate as described in the above model. The model can proceed after the mass flow at outlet condensate loss mass flow 323 (or a summation of outlet condensate mass flows at all measurement points or any combination thereof) has been reduced to 0 (or within a defined threshold of zero) to derive a coefficient "a" times super-heat quantity x, times the first mass flow 318 minus the second mass flow 319 and the fifth mass flow 323. Coefficient "a" can be derived from the terms of a total of the derived heat loss of super-heater outlet conduit 306 (e.g., which can be derived from temperature measurements made at one or more locations along the super-heater outlet conduit 306 and/or an analytical heat loss model) per distance c, times super-heater outlet length 307, plus the derived heat loss of down hole portion 311 (e.g., which can be derived from temperature measurements made at one or more locations along the down hole portion 311 and/or an analytical heat loss model) per distance d, times down hole portion length 310, plus a distance unit of measure, times volume of chamber 325, times a coefficient. In some embodiments, the distance unit of measure can be a length of the horizontal pipe section 312 that is in active communication with a bitumen product, potentially represented by line 313. This model example ignores the conditions in the optional multi-phase close-coupled heat exchanger system section for clarity.

In some embodiments, the heat loss through the close-coupled heat exchanger system can also be accounted for in the addition of a quantity of super-heat. For the sake of clarity, this extra step has not been included. Again the SOR at a location disposed in and/or proximate to the collection pipe 201 (e.g., ground surface location 24) can be used as a feedback or a metric to continuously iterate and optimize the level of superheat injected and continuously optimize the system or employ the principals of Kaizen. Again, upper limits of super-heated steam temperature boundary conditions can be employed. Process temperature feedbacks such as system pipe temperatures, process flows, process pressure feedbacks, system energy flow and many other feedbacks can be incorporated into ever exacting models with higher levels of sophistication to accurately schedule the optimum super-heat. Condensate flow and SOR are only two examples of feedbacks used in embodiments of the present disclosure.

Figure 2:
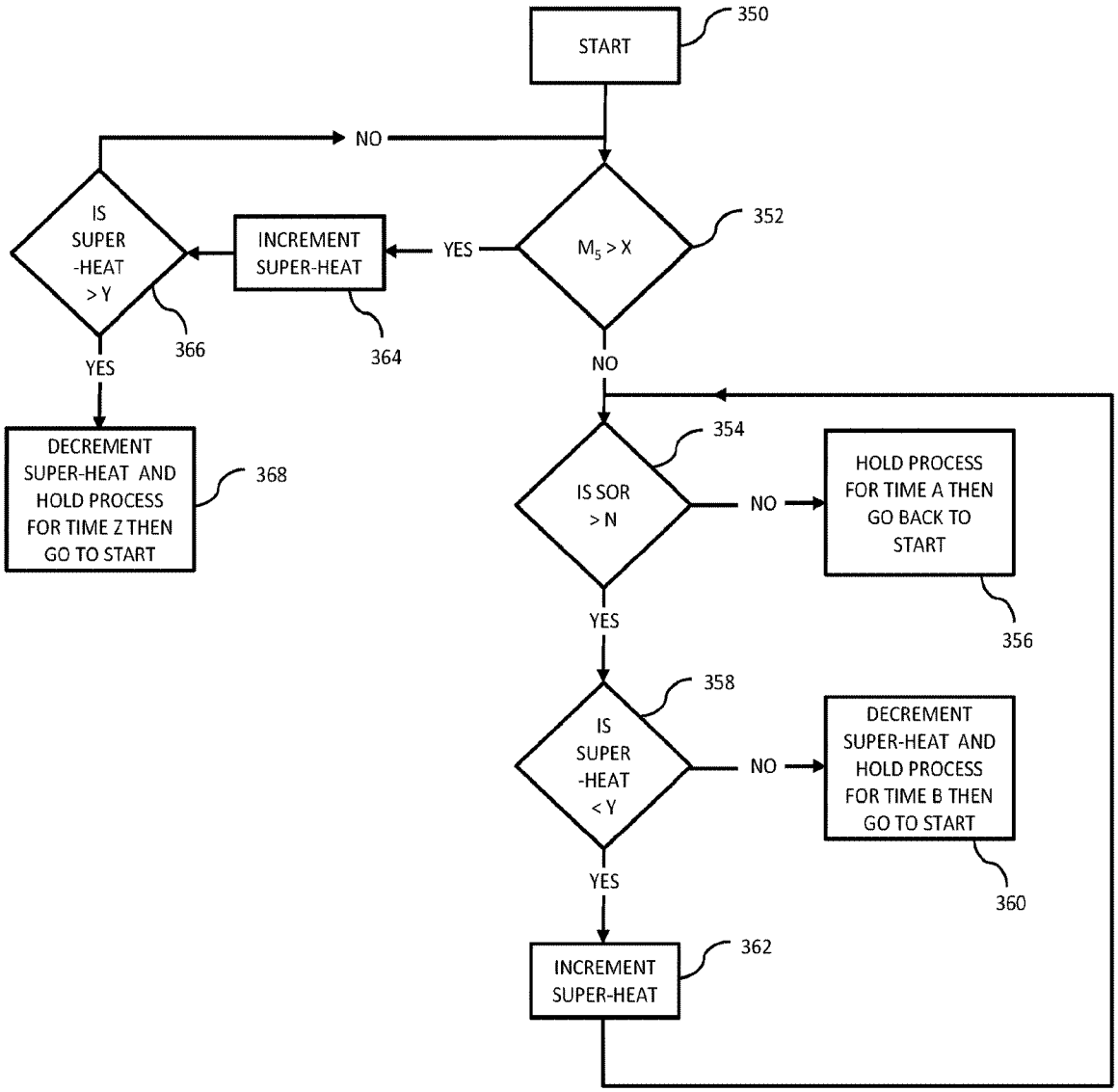
FIG. 2 depicts a flow chart associated with feedback control for controlling super-heat, in accordance with embodiments of the present disclosure.

FIG. 2 depicts a flow chart associated with feedback control for controlling super-heat, in accordance with embodiments of the present disclosure. In some embodiments, each block of the flow chart can represent an instruction, executable by a processor, as discussed herein. In some embodiments, each block of the flow chart can represent a method step, as discussed herein. The flow chart is depicted as starting at block 350. At decision block 352, a determination can be made of whether the condensate loss mass flow 323 (shown in FIG. 1 and also referred to herein as fifth mass flow 323 and depicted as Ms) is greater than a value X. The value X can be a measured numerical value associated with the fifth mass flow 323 (e.g., measured in a manner analogous to that discussed herein). In some embodiments, the value X can be 0. However, the value X can be greater than 0, for example, a value that is close to 0 and/or within a defined threshold of 0. As previously discussed, as condensate loss is minimized in the super-heater outlet conduit 306 (FIG. 1), the saturated steam can be allowed to effectively deliver its stored energy to the bitumen and the SOR can be improved and reduced numerically. Thus, while it is not necessary that the value X be 0, efficiency of the system can be increased as the value X approaches 0. For example, the value X can be less than or equal to 1 gallon per hour (e.g., the value X can be in a range from 0 to 1 gallons per hour). However, the value X can be greater than 1 gallon per hour.

As depicted in FIG. 2, in response to a determination that the fifth mass flow 323 is less than the value X (e.g., NO), control can be transferred to decision block 354, where a determination can be made of whether the SOR is greater than a value N (e.g., defined SOR value). The value N can be a determined numerical value associated with the SOR. In some embodiments, the value N can be defined by a user (e.g., received from a user via a user interface in communication with the computing device) and can be representative of a desired SOR. In response to a determination that the SOR is less than the value N (e.g. NO), control can be transferred to block 356, which can include an executable instruction to hold process for time A and then proceed to start at block 350. For example, block 356 can include an instruction to maintain a constant generation and/or temperature of super-heat (e.g., to not decrease or increase super-heat and/or to not decrease or increase super-heat outside of a defined range) for a particular time A. In some embodiments, the particular time A can be defined by a user. The particular time A can be 0 in some embodiments or a value greater than 0 (e.g., 1 second, 20 seconds, 3 minutes, 3 days, etc.). Upon the expiration of time A, the process can proceed to start block 350.

In response to a determination that the SOR is greater than the value N (e.g. YES), control can be transferred to decision block 358, where a determination can be made of whether a particular amount of super-heat generated and/or a temperature of the super-heat is less than a numerical value Y, which can be defined by a user. In some embodiments, the numerical value Y can be representative of an upper limit of a super-heated steam temperature boundary condition, as discussed herein. In response to a determination that the particular super-heat is greater than the value Y (e.g., NO), control can be transferred to block 360, which can include an executable instruction to decrement (e.g., decrease via open loop and/or a feedback control) super-heat and hold process for time B, then proceed to start. For example, block 360 can include an instruction to decrement a generation and/or temperature of super-heat for a particular time B. The particular time B can be a value greater than 0 (e.g., 1 second, 20 seconds, 3 minutes, 3 days, etc.). Upon the expiration of time B, the process can proceed to start block 350.

As depicted in FIG. 2, in response to a determination that the particular super-heat is less than the value Y (e.g., YES), control can be transferred to block 362, which can include an executable instruction to increment (e.g., increase) super-heat. For example, block 362 can include an instruction to increment an amount and/or temperature of super-heat generated. In some embodiments, the amount and/or temperature of super-heat generated can be incremented for a defined time before control is transferred back to decision block 354.

As depicted in FIG. 2, in response to a determination that the fifth mass flow 323 is greater than the value X (e.g., YES), control can be transferred to block 364, which can include an executable instruction to increment super-heat. For example, block 364 can include an instruction to increment an amount and/or temperature of super-heat generated. In some embodiments, the amount and/or temperature of super-heat generated can be incremented for a defined time before control is transferred back to decision block 366.

At decision block 366, a determination can be made of whether a particular amount of super-heat generated and/or a temperature of the super-heat is greater than the numerical value Y (e.g., defined super-heat value), which can be defined by a user. In some embodiments, the numerical value Y can be representative of an upper limit of a super-heated steam temperature boundary condition, as discussed herein. In response to a determination that the particular super-heat is greater than the value Y (e.g., YES), control can be transferred to block 368, which can include an executable instruction to decrement super-heat and hold process for time Z, then proceed to start. For example, block 368 can include an instruction to decrement a generation and/or temperature of super-heat for a particular time Z. The particular time Z can be a value greater than 0 (e.g., 1 second, 20 seconds, 3 minutes, 3 days, etc.). Upon the expiration of time B, the process can proceed to start block 350. As discussed herein, a generation and/or temperature of super-heat can be incremented or decremented via use of feedback control, which can be implemented with the assistance of a feedback controller, such as a PID controller.

Embodiments are described herein of various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment", or the like, means that a particular feature, structure, or characteristic described in connection with the embodiment(s) is included in at least one embodiment. Thus, appearances of the phrases "in various embodiments," "in some embodiments," "in one embodiment," or "in an embodiment," or the like, in places throughout the specification, are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It will be further appreciated that for conciseness and clarity, spatial terms such as "vertical," "horizontal," "up," and "down" may be used herein with respect to the illustrated embodiments. However, these terms are not intended to be limiting and absolute.

Although at least one embodiment for a method, apparatus, and system for enhanced oil and gas recovery with direct steam generation, multiphase close-coupled heat exchanger system, super focused heat has been described above with a certain degree of particularity, those skilled in the art could make numerous alterations to the disclosed embodiments without departing from the spirit or scope of this disclosure. All directional references (e.g., upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the devices. Joinder references (e.g., affixed, attached, coupled, connected, and the like) are to be construed broadly and can include intermediate members between a connection of elements and relative movement between elements. As such, joinder references do not necessarily infer that two elements are directly connected and in fixed relationship to each other. It is intended that all matter contained in the above description or shown in the accompanying drawings shall be interpreted as illustrative only and not limiting. Changes in detail or structure can be made without departing from the spirit of the disclosure as defined in the appended claims.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

The invention claimed is:

1. A system for improving a steam oil ratio (SOR) comprising:

a direct steam generator (DSG) boiler fluidly coupled with a downhole portion of a steam system via at least a DSG outlet, wherein the DSG boiler is configured to schedule super-heat delivered to the downhole portion to optimize the SOR associated with the system, wherein an amount of super-heat is adjusted based on a determination of a condensate loss from the DSG outlet.

2. The system of claim 1, wherein the super-heat generated at the DSG is employed to aid in the separation of impurities in a separation device, the separation device being directly coupled to the DSG outlet.

3. The system of claim 2, wherein the impurities originate from at least one of a feedwater and a fuel fed to the DSG, wherein the feedwater comprises components selected from the group consisting of dirty water, brine water, fossil water, sea water, produced water, fresh make up water, and pond water from oil processing.

4. The system of claim 2, wherein the separation device is disposed between the DSG and the downhole portion of the steam system, the separation device fluidly coupled with the downhole portion and the DSG via the DSG outlet.

5. The system as in any one of claim 2, wherein blowdown from the separation device is eliminated or reduced by running the DSG boiler in a super-heated mode of operation.

6. The system of claim 5, wherein the separation device includes at least one of a conventional cyclone, box, mesh, or baffle system.

7. The system of claim 1, further comprising:

an additional super-heater run in series with the DSG boiler; and the downhole portion of the steam system fluidly coupled with the additional super-heater via at least the DSG outlet, wherein the DSG boiler and the additional super-heater are configured to schedule super-heat delivered to the downhole portion to optimize the SOR associated with the system.

8. A system for improving a steam oil ratio (SOR) comprising:

a direct steam generator (DSG) boiler;

a multi-phase close-coupled heat exchanger fluidly coupled with the DSG boiler, where the DSG boiler is run in a manner to create super-heat; and a downhole portion of a steam system fluidly coupled with the close coupled heat exchanger, wherein the DSG boiler is configured to schedule super-heat delivered to the downhole portion to optimize the SOR associated with the system; wherein:

a mathematical model is used to schedule a required total super-heat utilized in a production of process steam; and the mathematical model is iteratively applied to schedule the required total super-heat utilized in the production of process steam.

9. The system of claim 8, further comprising:

a super-heater run in series and fluidly coupled with the DSG boiler and the multiphase close-coupled heat exchanger; and the downhole portion of the steam system fluidly coupled with the super-heater, wherein the DSG boiler and the super-heater are configured to schedule super-heat delivered to the downhole portion to optimize the SOR associated with the system.

10. A method for improving a steam oil ratio (SOR) comprising:

providing super-heat with at least one of a direct steam generator (DSG) boiler and a super-heater fluidly coupled in series with a downhole portion of a steam system to the downhole portion of the steam system, wherein the DSG boiler is fluidly coupled with the super-heater via a DSG outlet and the super-heater is fluidly coupled with the downhole portion of the steam system via a super-heater outlet conduit;

determining whether a condensate loss from the super-heater outlet conduit is greater than a defined condensate loss value; and adjusting the amount of super-heat based on the determination of whether the condensate loss from the super-heater outlet conduit is greater than the defined condensate loss value.

11. The method of claim 10, wherein a close-coupled heat exchanger is fluidly coupled between the DSG boiler and the super-heater.

12. The method of claim 10, further comprising incrementing the amount of super-heat to provide an incremented amount of super-heat in response to a determination that the condensate loss from the super-heater outlet conduit is greater than the defined condensate loss value.

13. The method of claim 12, further comprising:

determining whether the incremented amount of super-heat is greater than a defined super-heat value; and decrementing the amount of super-heat in response to a determination that the incremented amount of super-heat is greater than the defined super-heat value.

14. The method of claim 13, further comprising determining whether the condensate loss from the super-heater outlet conduit is greater than the defined condensate loss value, in response to a determination that the incremented amount of super-heat is less than the defined super-heat value.

15. The method of claim 10, further comprising determining whether the SOR is greater than a defined SOR value in response to a determination that the condensate loss from the super-heater outlet conduit is less than the defined condensate loss value.

16. The method of claim 15, further comprising maintaining the amount of super-heat in response to a determination that the SOR is less than the defined SOR value.

* * * * *